US011236479B2

(12) United States Patent
Legnaioli

(10) Patent No.: US 11,236,479 B2
(45) Date of Patent: Feb. 1, 2022

(54) SNOW AND ICE MELTING DEVICE

(71) Applicant: Richard W Legnaioli, Cambridge, MA (US)

(72) Inventor: Richard W Legnaioli, Cambridge, MA (US)

( * ) Notice: Subject to any disclaimer, the term of this patent is extended or adjusted under 35 U.S.C. 154(b) by 450 days.

(21) Appl. No.: 16/249,078

(22) Filed: Jan. 16, 2019

(65) Prior Publication Data

US 2019/0218734 A1 Jul. 18, 2019

Related U.S. Application Data

(60) Provisional application No. 62/789,916, filed on Jan. 8, 2019, provisional application No. 62/617,798, filed on Jan. 16, 2018.

(51) Int. Cl.
*E01H 5/10* (2006.01)

(52) U.S. Cl.
CPC ..... *E01H 5/102* (2013.01)

(58) Field of Classification Search
CPC ..... E01H 5/10; E01H 5/102; E01H 5/106
See application file for complete search history.

(56) References Cited

U.S. PATENT DOCUMENTS 961,604 A * 6/1910 Goff ..... E01H 5/102 126/343.5 R
1,203,531 A * 10/1916 Givens ..... A01M 15/00 126/271.2 C
1,298,200 A * 3/1919 Gorgey ..... E01H 5/02 37/230
1,515,553 A * 11/1924 Cummings ..... E01H 5/104 37/227
1,518,320 A * 12/1924 Gates ..... B44D 3/168 401/22
1,526,903 A * 2/1925 Connolly ..... E01H 5/10 37/197
RE16,081 E * 5/1925 Connolly ..... E01H 5/10 37/227
1,629,160 A * 5/1927 Heermance ..... E01H 5/10 239/130
1,652,767 A * 12/1927 Daly ..... E01H 5/10 126/271.1
1,681,104 A * 8/1928 Earnhardt ..... E01H 5/10 126/271.2 A
1,702,029 A * 2/1929 Coic ..... E01H 5/10 37/227

(Continued)

*Primary Examiner* — Jamie L McGowan
(74) *Attorney, Agent, or Firm* — Mark David Torche; Patwrite Law

(57) ABSTRACT

A snow and ice melting device has a frame that uses a trailer hitch to connect to a propane truck. The frame also holds a plurality of flame nozzles that directs heat down towards a snow and/or ice covered surface. In one embodiment, at least one propane tank is provided that allows the device to be hooked up to any vehicle rather than a propane truck such as a pickup truck, or small tractor. In one embodiment, a front mounted snow and ice melting device is also attached to the front of the vehicle to further enhance the snow and melting effect. In another embodiment, the snow and ice melting device has a frame that holds a propane tank. The frame has a handle and wheels to allow the user to maneuver the device to melt ice and snow. A riding embodiment is also shown.

13 Claims, 21 Drawing Sheets

(56) References Cited

U.S. PATENT DOCUMENTS 1,759,859 A * 5/1930 Court ..... E01H 5/10 126/271.2 C
2,604,023 A * 7/1952 Messiah ..... E01C 11/223 219/213
2,610,622 A * 9/1952 Coggin ..... E01H 5/10 126/271.2 C
2,699,614 A * 1/1955 Welch ..... E01H 5/10 37/229
2,820,450 A * 1/1958 Zimmerman ..... E01H 5/106 126/271.2 A
2,977,695 A * 4/1961 Kesecker ..... E01H 5/104 37/230
3,174,477 A * 3/1965 Wilson ..... E01H 5/106 126/271.2 A
3,223,079 A * 12/1965 Keusder ..... A01M 15/00 126/271.2 A
3,291,118 A * 12/1966 Wilson ..... E01H 5/106 126/271.2 R
3,311,104 A * 3/1967 Wollner ..... E01C 23/14 126/92 R
3,509,871 A * 5/1970 Laurendo ..... E01H 5/10 126/271.2 R
3,771,188 A * 11/1973 Guth ..... E04D 15/006 15/105
3,989,925 A * 11/1976 Garner ..... E04D 13/103 219/227
4,033,055 A * 7/1977 Lazarecky ..... E01H 5/02 37/230
4,034,489 A * 7/1977 Hughes, Jr. ..... E01H 5/02 37/230
4,918,844 A * 4/1990 Marsh ..... E01H 4/023 126/271.2 R
5,140,762 A * 8/1992 Monson ..... E01H 5/106 37/227
5,867,926 A * 2/1999 Schmitt ..... E01H 5/106 37/227
5,948,299 A * 9/1999 Scalia ..... E01H 5/106 219/228
6,353,212 B1 * 3/2002 Smith ..... E01H 5/104 219/533
6,408,843 B1 * 6/2002 Olson ..... A01M 21/04 126/271.2 R
6,551,017 B1 * 4/2003 Strassman ..... E01C 23/14 404/77
6,595,200 B1 * 7/2003 Dai ..... F24H 3/0488 126/110 B
7,190,887 B1 * 3/2007 Compton ..... F24H 3/0417 219/533
7,364,240 B2 * 4/2008 Seely ..... E01H 4/023 299/24
7,716,857 B2 * 5/2010 Nagamatsu ..... E02F 3/7609 37/241
7,823,579 B2 * 11/2010 Vandrak ..... F24H 3/0488 126/116 R
8,428,446 B1 * 4/2013 Pimentel ..... E01H 5/106 392/383
8,443,530 B2 * 5/2013 Pender ..... E01H 4/023 37/219
9,957,680 B1 * 5/2018 Bargoot ..... E01H 5/10
10,000,901 B1 * 6/2018 Gallo ..... F21V 33/0084
10,260,209 B1 * 4/2019 Malkov ..... E01H 5/104
10,378,167 B1 * 8/2019 Mankarious Awad .... E01H 5/08
10,767,322 B1 * 9/2020 Heiligenstein ..... F25D 21/006
2006/0083493 A1 * 4/2006 Dolton, III ..... E01H 5/106 392/384
2012/0006804 A1 * 1/2012 Jenkins ..... E01H 5/106 219/202
2019/0127935 A1 * 5/2019 Campbell ..... E01H 5/02

* cited by examiner

SNOW AND ICE MELTING DEVICE

CROSS REFERENCE TO RELATED APPLICATIONS

This application claims priority to Provisional Application Ser. Nos. 62/617,798, filed on Jan. 16, 2018 and 62/789,916, filed on Jan. 8, 2019, the complete disclosures of each of which are hereby incorporated by reference.

BACKGROUND OF THE INVENTION

Snow removal has been an issue for a long time. It became very important as more people moved from an agricultural based economy to an industrial and more urban environment. The movement of food and people can be greatly influenced by snow and ice. The shovel was certainly one of the first snow removal inventions developed and for small scale snow removal they are reasonably efficient. When larger areas of snow removal was needed, horse pulled plows were used to move snow but of course these horse driven plows could not push snow and were limited in their effectiveness. Railroads used plows fitted to locomotives to clear the tracks and some early snow plow patents were granted in the mid-1800s. Plows were fitted on trams and trolleys but these proved impractical. Many cities started building underground subway systems, but snow was still a problem since not everything can be put underground.

A problem common to snow plow designs is the fact that they merely move the snow from one place to another. While this can be effective, it does not always deal with the problem of where to put the snow once plowed. Additionally, plows are not effective in removing ice. Ice removal is usually done using salt or sand, but this has environmental implications and is only effective in a range of temperatures. If the temperature is too cold, salt will not be effective in melting the ice. In some cases, snow would be placed in trucks and carried away to be deposited elsewhere such as a river.

While these solutions were somewhat effective for cities and large areas, they were not very useful by an individual trying to clear a driveway or sidewalk. Large scale snow blowers, machines that lifted the snow and directed it up and out to a different area were developed. Individual snow blowers were invented to help individuals remove snow from small areas without the need for shoveling.

There is a need for a device which removes snow and ice without the need to move it from one location to another.

SUMMARY OF THE INVENTION

A snow and ice melting device has a frame that uses a trailer hitch to connect to a propane truck. The frame also holds a plurality of flame nozzles that directs heat down towards a snow and/or ice covered surface. In one embodiment, at least one propane tank is provided that allows the device to be hooked up to any vehicle rather than a propane truck such as a pickup truck, or small tractor. In one embodiment, a front mounted snow and ice melting device is also attached to the front of the vehicle to further enhance the snow and melting effect. In another embodiment, the snow and ice melting device has a frame that holds a propane tank. The frame has a handle and wheels to allow the user to maneuver the device to melt ice and snow. A riding embodiment is also shown.

Other features and advantages of the instant invention will become apparent from the following description of the invention which refers to the accompanying drawings.

DETAILED DESCRIPTION OF THE INVENTION

Figure 1:
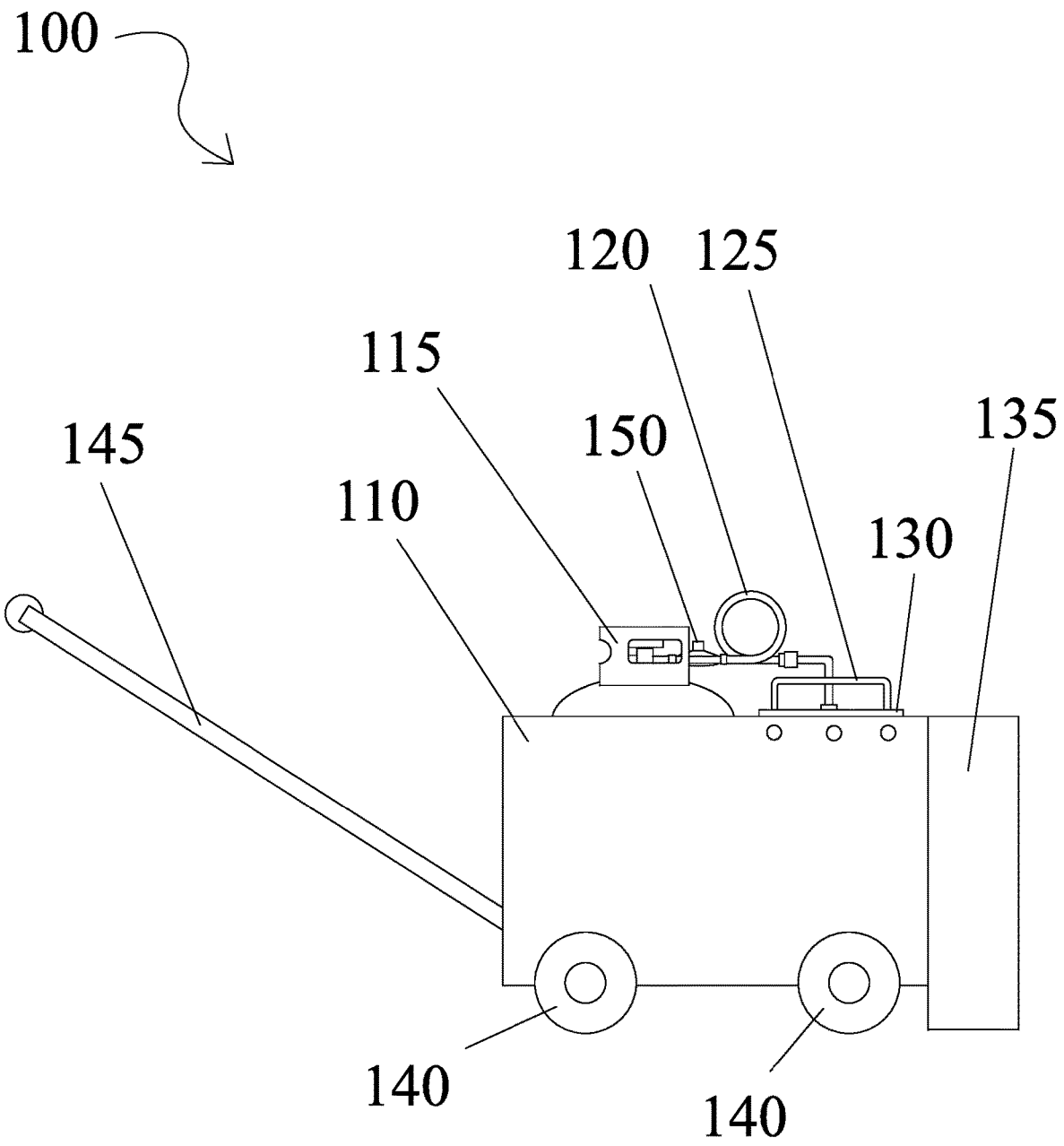
FIG. 1 is a side view of a snow and ice melting device according to an embodiment of the invention.
Figure 2:
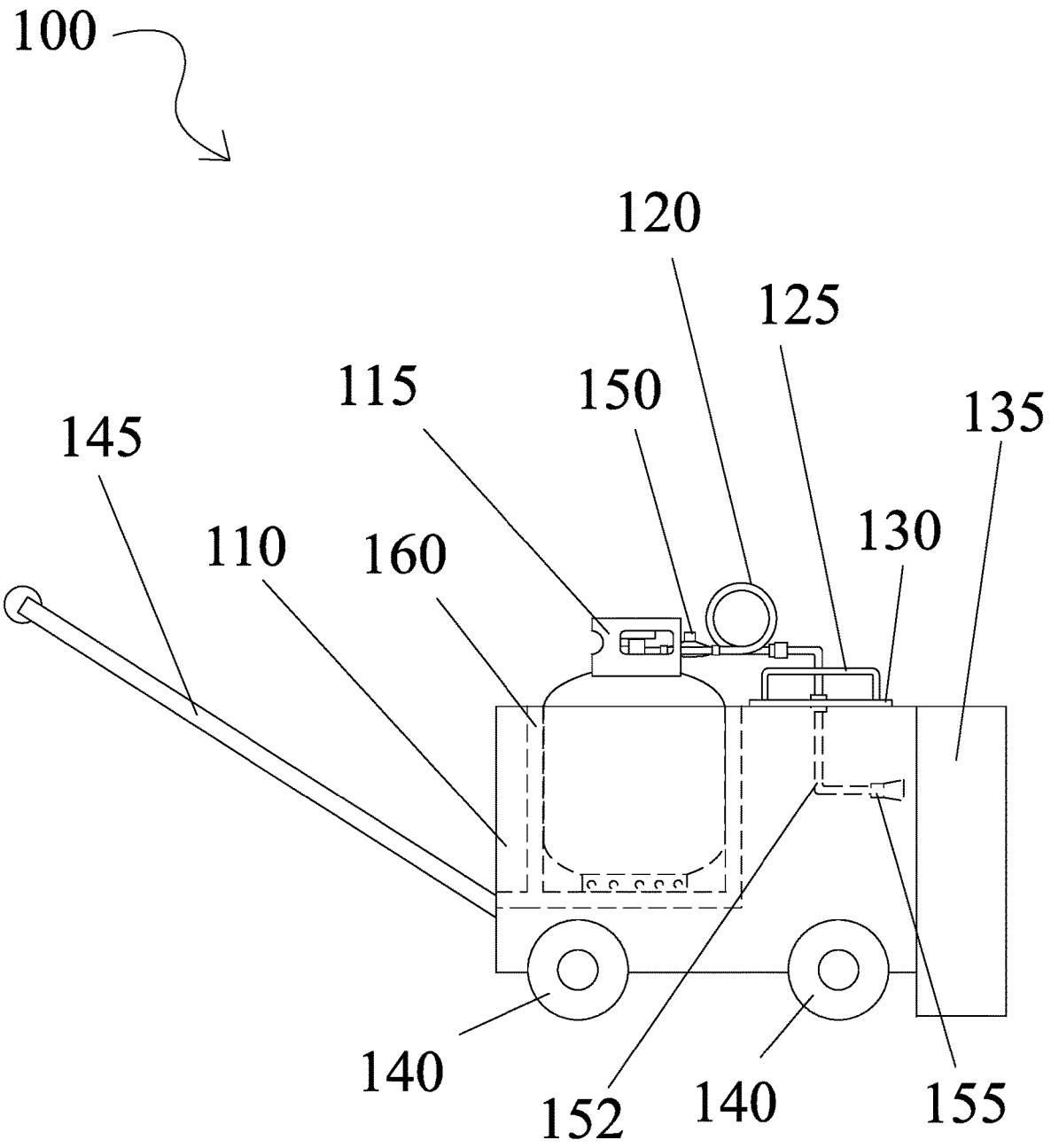
FIG. 2 is a side transparent view of the snow and ice melting device shown in FIG. 1.
Figure 3:
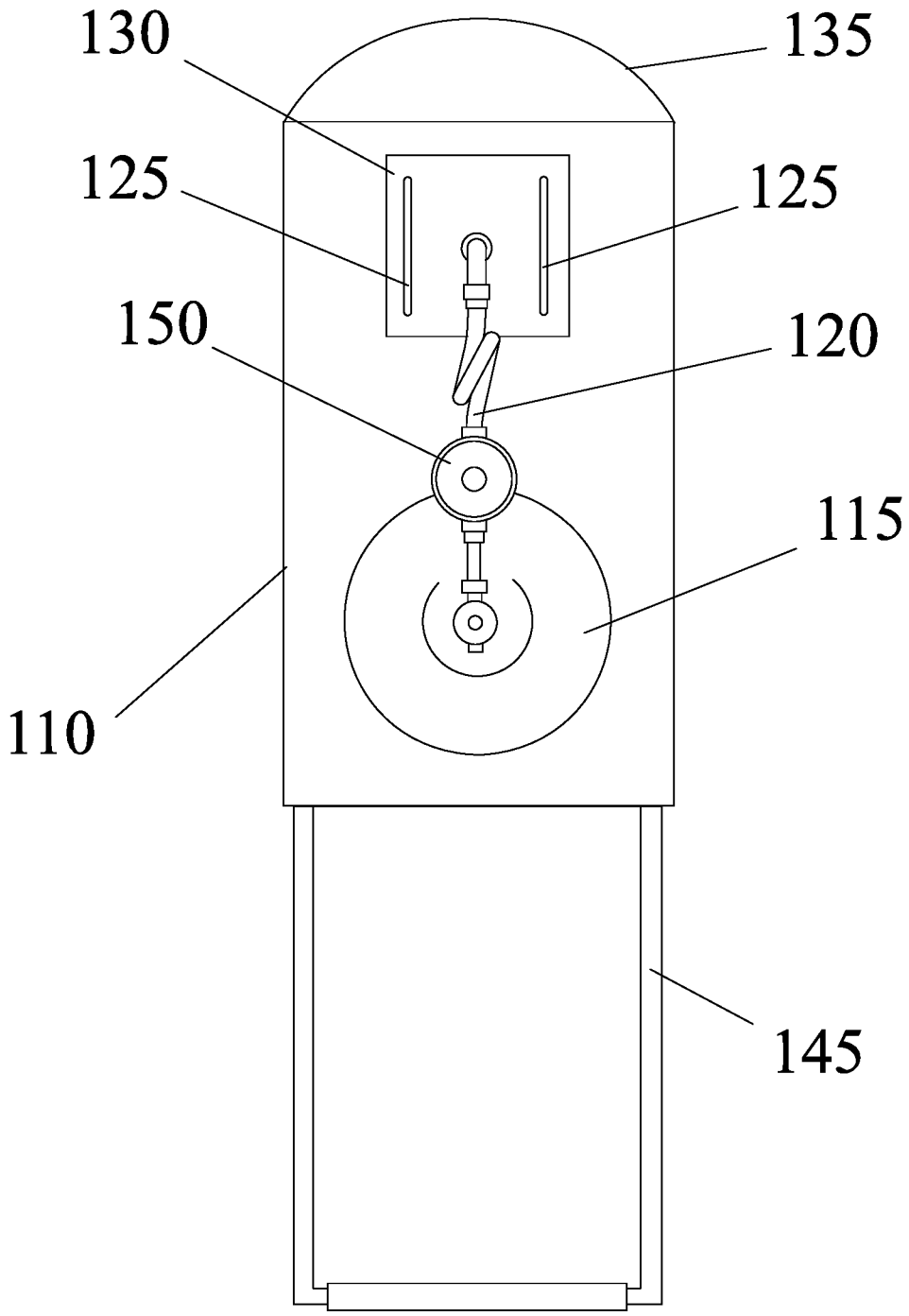
FIG. 3 is a top view of the snow and ice melting device shown in FIG. 1.
Figure 4:
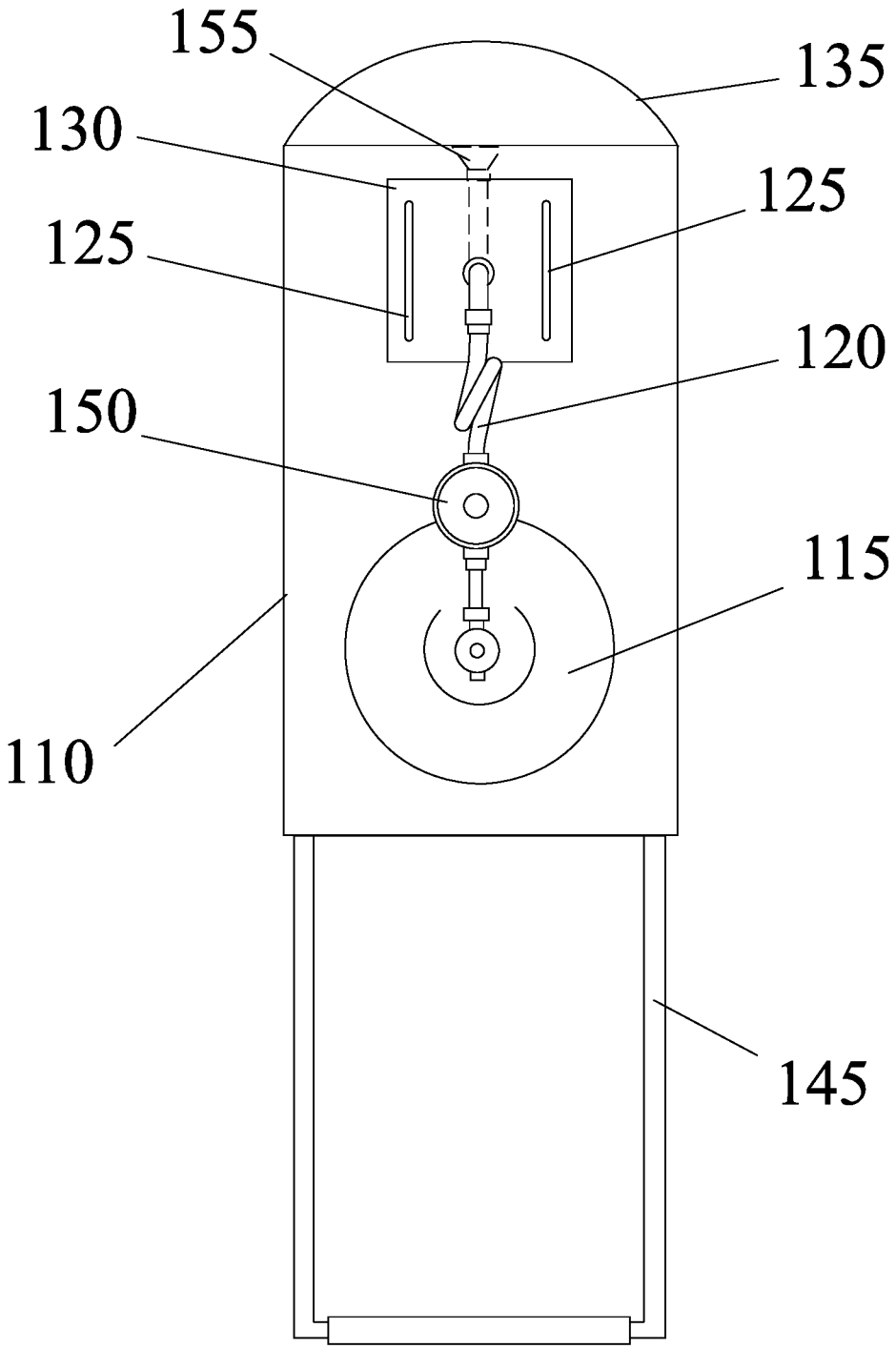
FIG. 4 is a top transparent view of the snow and ice melting device shown in FIG. 3.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to FIGS. 1 through 4, a snow and ice melting device 100 is shown having a frame 110. Frame 110 provides the structural support to hold the various components and to provide support for a handle 145 that is used to control and move snow and ice melting device 100. Four wheels 140 are used to allow device 100 to move. Of course other arraignments such as three wheels, skids, tracks or other method to allow movement may be used as long as an individual can maneuver device 100 to melt ice and snow as is known in the art.

A propane tank 115 is held in place using propane tank supports 160 which are welded or bolted to frame 110. A regulator 150 is provided to regulate the propane along with a gas line 120 to connect the regulated propane to a flame nozzle assembly 152 which feeds a flame nozzle 155. A heat plate 135 is provided to facilitate heat transfer from flame nozzle 155 to heat plate 135. Heat plate 135 may make contact with snow and it also directs heat downward to melt ice beneath heat plate 135.

Flame nozzle 155 is located so that the flame from flame nozzle 155 is directed towards heat plate 135. Access to flame nozzle assembly 152 is through a burner access panel 130. A handle 125 is provided to allow the user to lift burner access panel 130. Heat plate 135 is rounded forming a semi-circular shape to evenly distribute the heat produced when flame nozzle 155 is operating. Heat plate 135 is made of steel but can be made of any suitable material such as, but not limited to aluminum or sheet metal, etc. Of course other geometries may be used for the heat plate, such as, but not limited to triangular, rectangular, etc.

Frame 110 is also made of metal and is strong enough to support full propane tank 115 and the associated apparatus discussed above. Additionally flame nozzle 155 may be fan-shaped, circular or other suitable shape as is known in the art. Also, an electronic ignitor (not shown) may be provided to allow the user to ignite flame nozzle 150 or the user may lift burner access panel and use an external ignition source (not shown) such as a striker. Regulator 150 may be factory preset to deliver a constant flame or may be adjustable as is known in the art.

Figure 5:
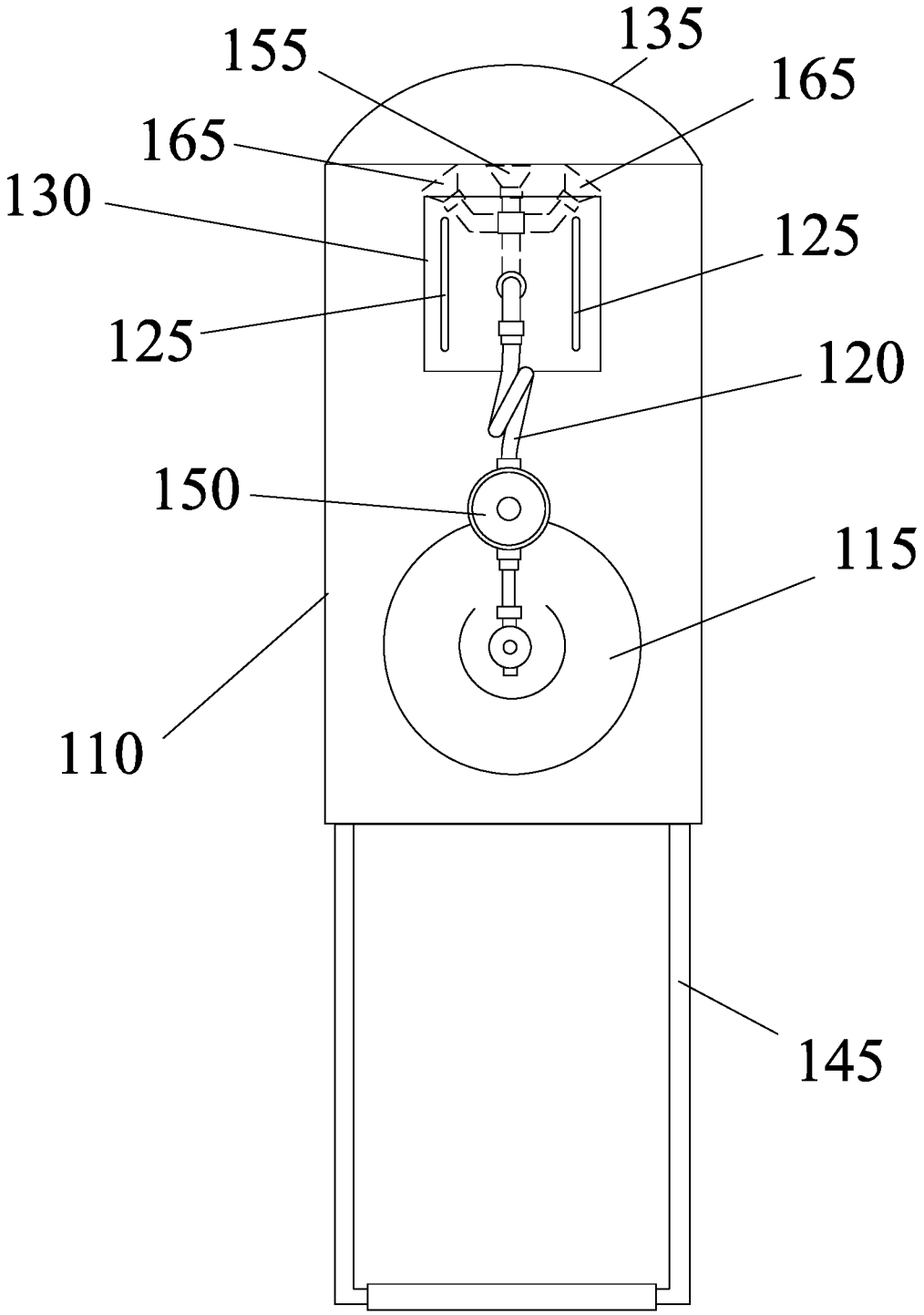
FIG. 5 is a top transparent view of a snow and ice melting device with an alternative flame nozzle location.
Figure 6:
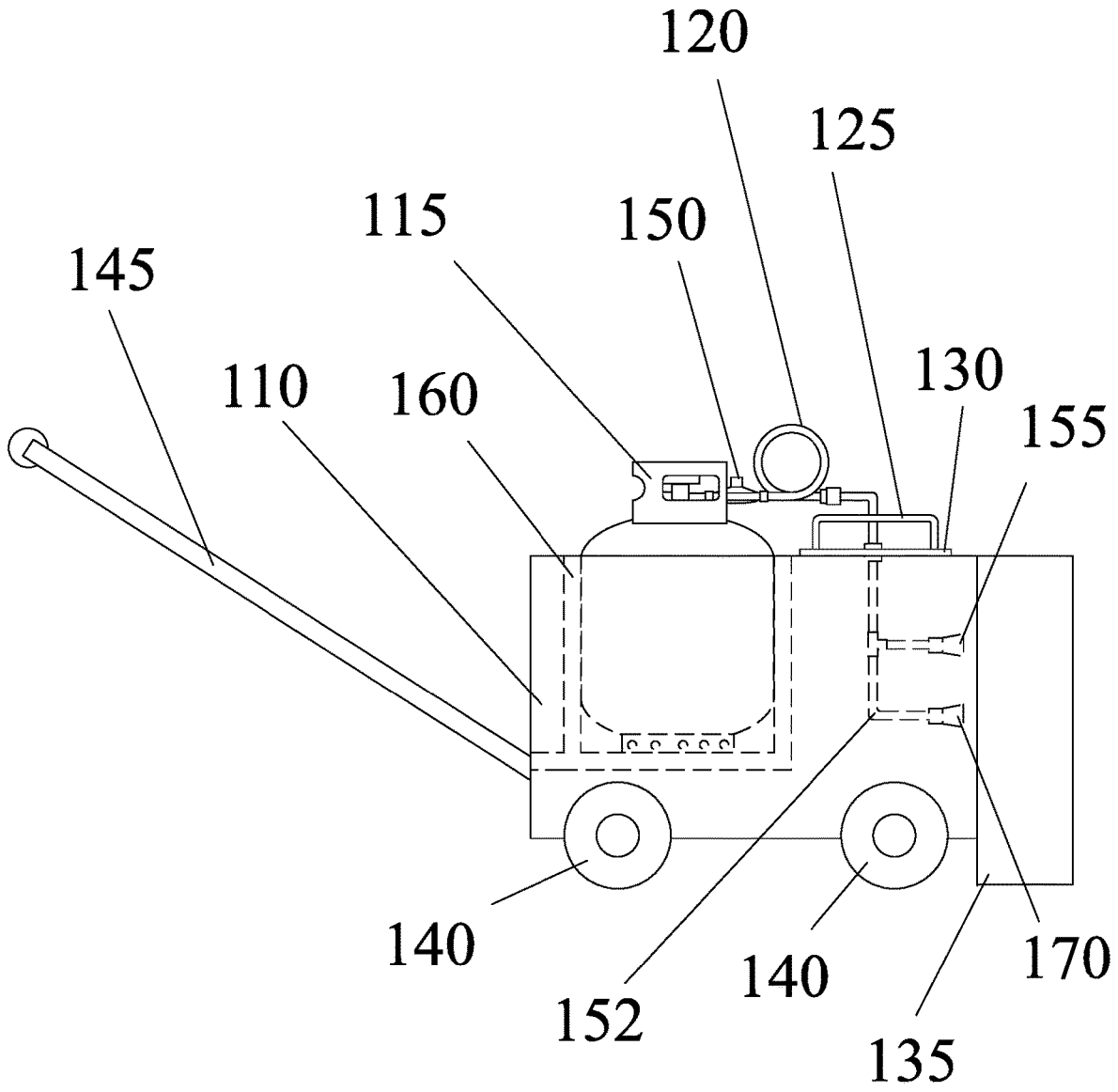
FIG. 6 is a side transparent view of a snow and ice melting device having multiple flame nozzles.

Referring now to FIGS. 5 and 6, snow and ice melting device 100 is shown having multiple flame nozzles 155 and 170. Upper flame nozzles 155 are used in conjunction with lower flame nozzles 170 to provide more heating for faster melting of ice and snow. Upper flame nozzle 155 has two flame nozzles 165 angled to provide even heating to heat plate 135. Similarly, lower flame nozzles 170 also has three nozzles. Of course other arrangements could be used, such as but not limited to two, four or any other number or arrangements of flame nozzles to provide heat to melt ice and snow.

Figure 7:
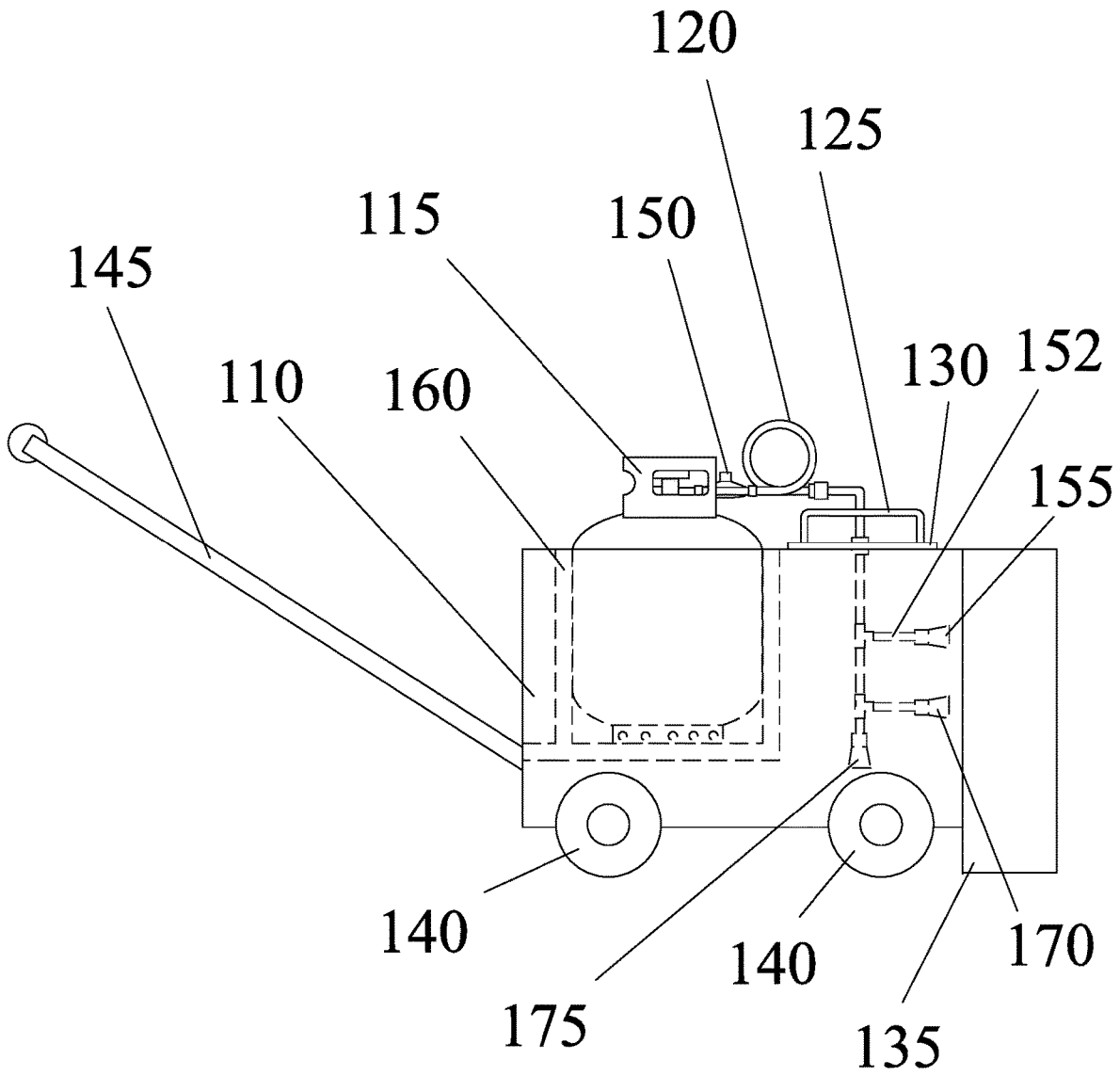
FIG. 7 is a side transparent view of a snow and ice melting device having multiple flame nozzles in an alternative location.

Now referring to FIG. 7, snow and ice melting device 100 has an additional flame nozzle 175 directed down towards the ground for additional ice and snow melting. Again as discussed above, the arrangement of the nozzles may be positioned in a number of different ways as long as they provide heat to melt the ice and snow.

Figure 8:
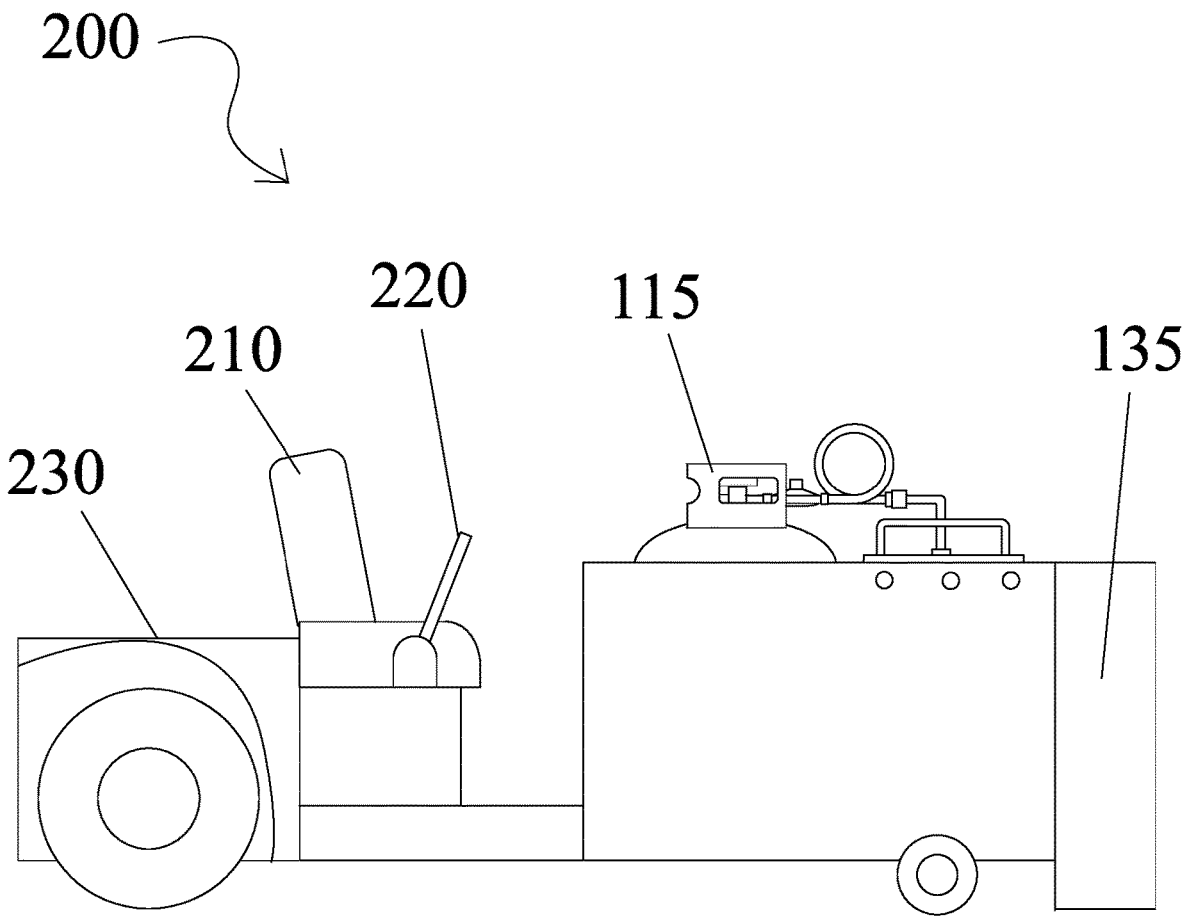
FIG. 8 is a side view of a riding embodiment of a snow and ice melting device according to an embodiment of the invention.

Referring now to FIG. 8, a riding snow and ice melting device is shown having a power assembly 230, seat 210 and steering mechanism 220 with propane tank 115 attached to a front section of riding device 200 with heat plate 135 providing the heat to melt the snow and ice as described above. Of course other steering mechanism as well as battery operated motors, gasoline, diesel or any other suitable power source may be used as is known in the art. Additionally, a cab portion (not shown) may be provided to give the user a heated and sheltered environment in which to operate the device.

Figure 9:
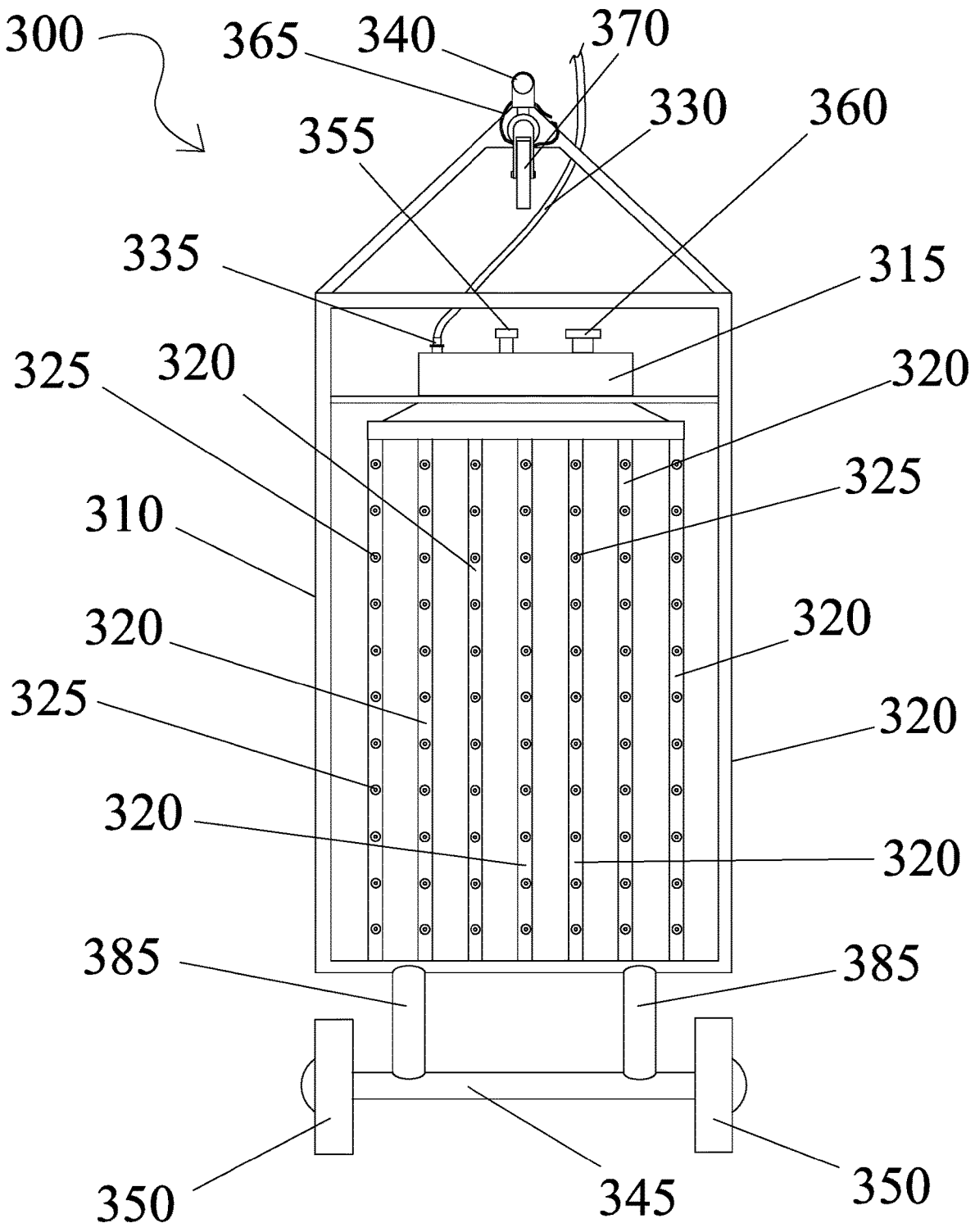
FIG. 9 is a bottom view of a snow and ice melting trailer device according to an embodiment of the invention.
Figure 10:
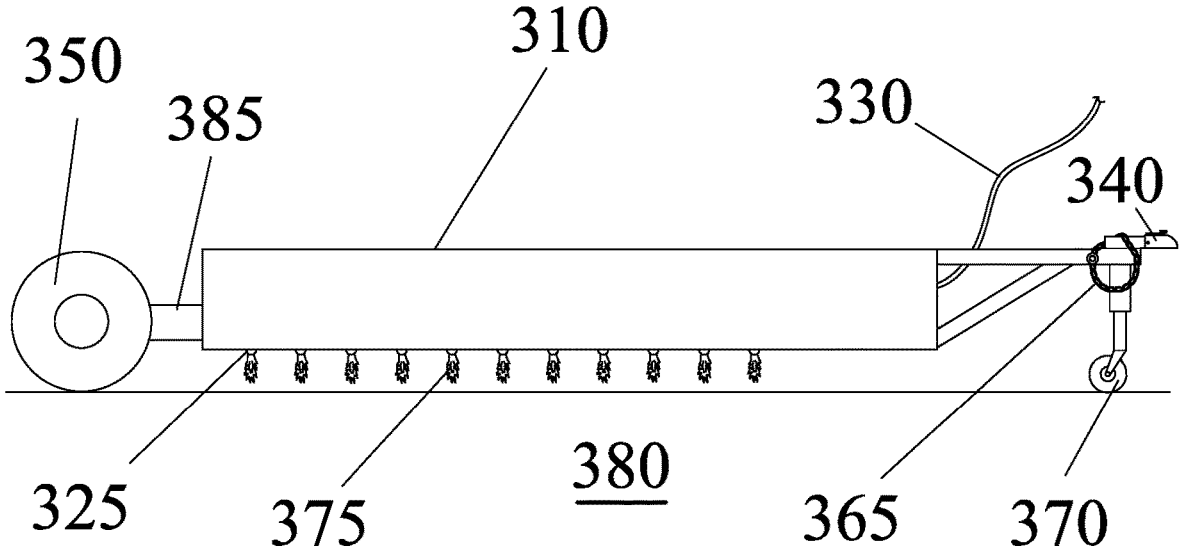
FIG. 10 is a side view of the snow and ice melting trailer device shown in FIG. 9.

Referring to FIGS. 9 and 10, a snow and ice melting device 300 is shown having a frame 310. Frame 310 provides the structural support to hold a trailer hitch 340. Trailer hitch 340 is generally conventional and includes a jockey wheel 370, safety chain 365 as is known in the art. Frame 310 also provides a pair of axle supports 385, axle 345 and wheels 350. A burner jet support 320 is firmly securely welded to frame 310. Of course other means of attachment may be used such as bolts, etc. Burner jet support 320 includes a plurality of burner jets 325 which direct flame 375 downwards to melt ice and snow.

Burner jet support includes a propane manifold 315 which is used to supply propane to burner jets 325 as is known in the art. Propane manifold 315 includes an emergency shutoff 355 and a burner jet control 360. Other controls and gauges may be provided. A propane line 330 attaches to propane manifold 315 with a propane connection 335. In operation, burner jets 325 are ignited producing flames 375 which is directed towards ice and or snow covered surface 380.

Figure 11:
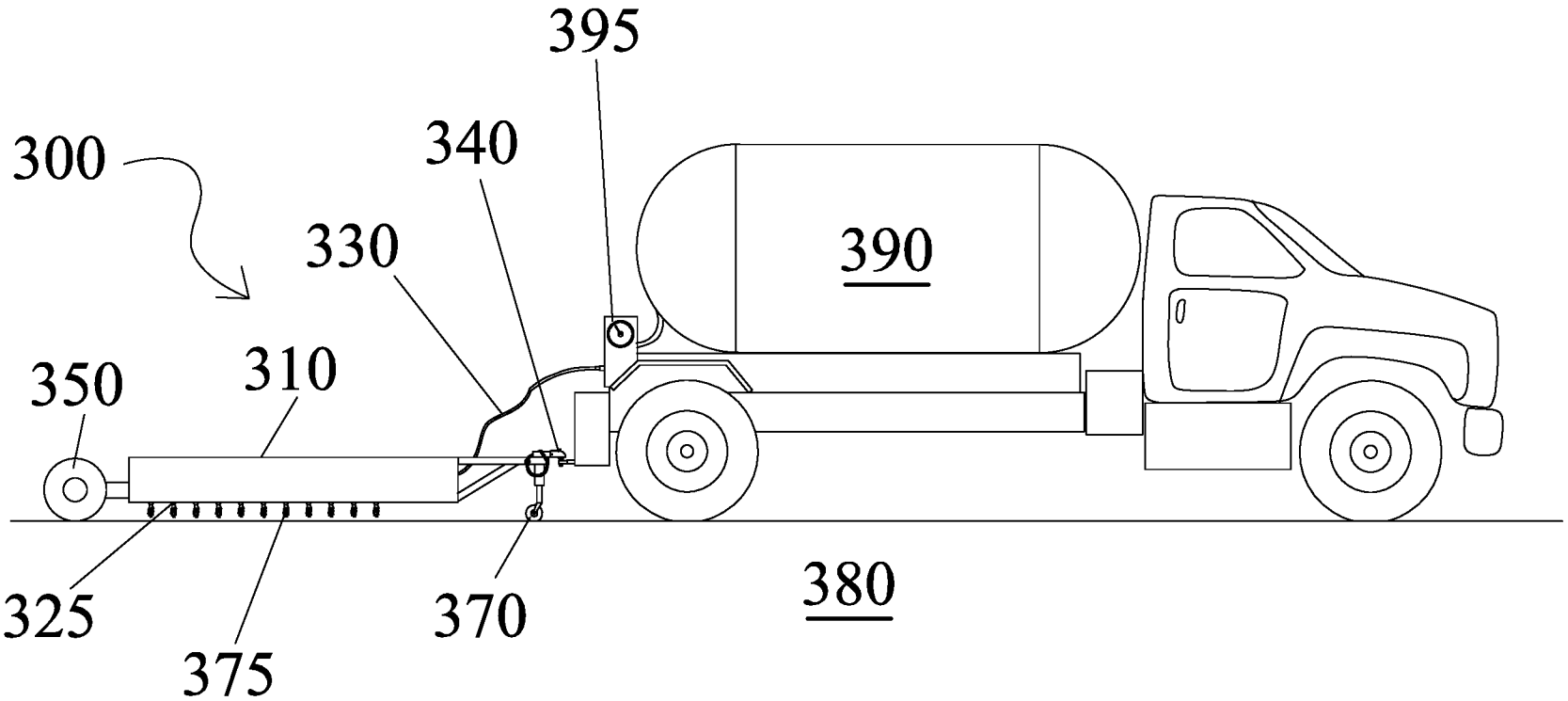
FIG. 11 is a side view of the snow and ice melting trailer device shown in FIG. 9 attached to a propane truck.

Referring now to FIGS. 9-11, commercial snow and ice melting device 300 is shown attached to a propane truck 390. Propane truck 390 provides the propane to feed burner jets 325 to produce the heat required to melt the snow and ice. Propane truck 390 has gauges and regulators 495 to ensure proper fuel regulation as is known in the art.

Figure 12:
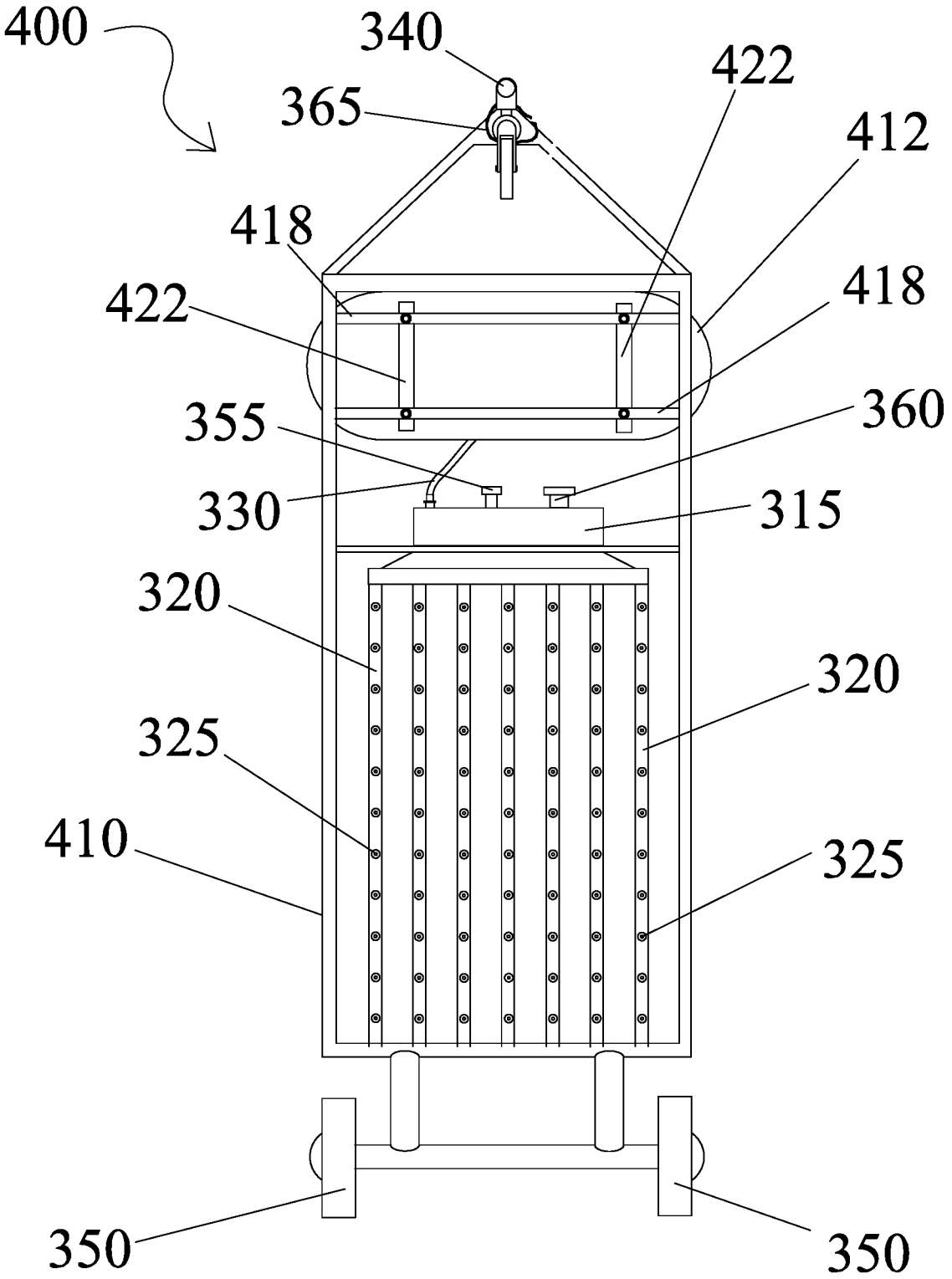
FIG. 12 is a bottom view of the snow and ice melting trailer device shown in FIG. 9.
Figure 13:
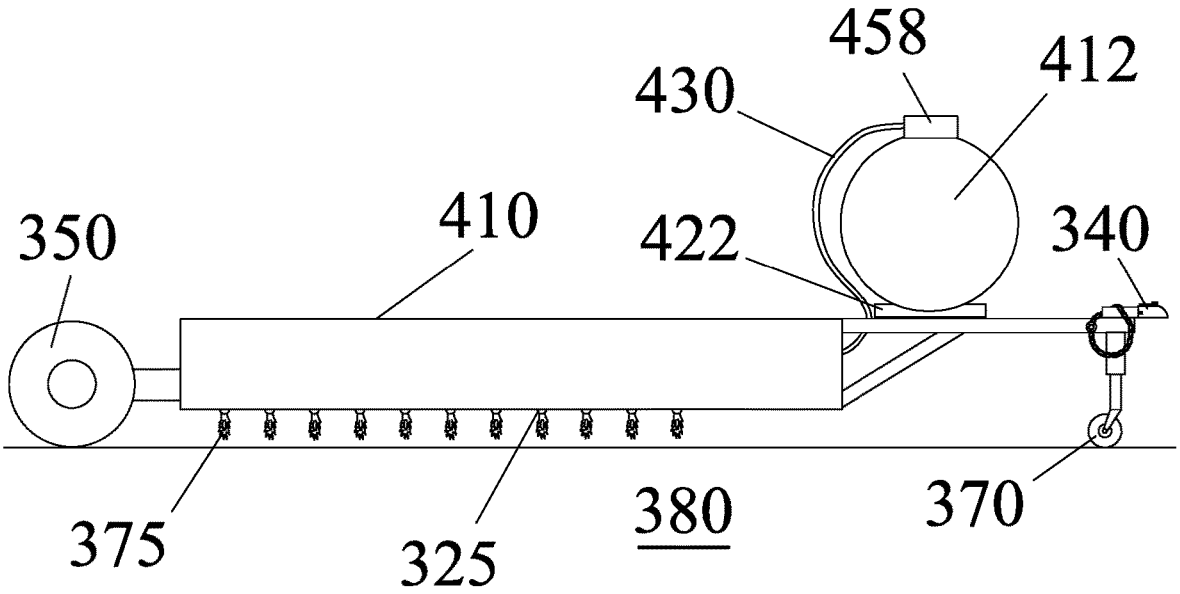
FIG. 13 is a side view of a snow and ice melting trailer device with an attached propane tank.

Now referring to FIGS. 12 and 13, a commercial snow and ice melting device 400 is shown with a frame 410 which includes propane tank supports 418 which hold propane tank legs 422. A propane tank 412 is mounted on propane tank supports 418 to provide propane to burner jets 325 as described above. A regulator 458 connects to propane manifold 315 using a propane line 430 and is provided to regulate the propane flow as is known in the art. In this embodiment, commercial snow and ice melting device 400 may be attached any vehicle capable of towing a trailer since it does not require a propane truck.

Figure 14:
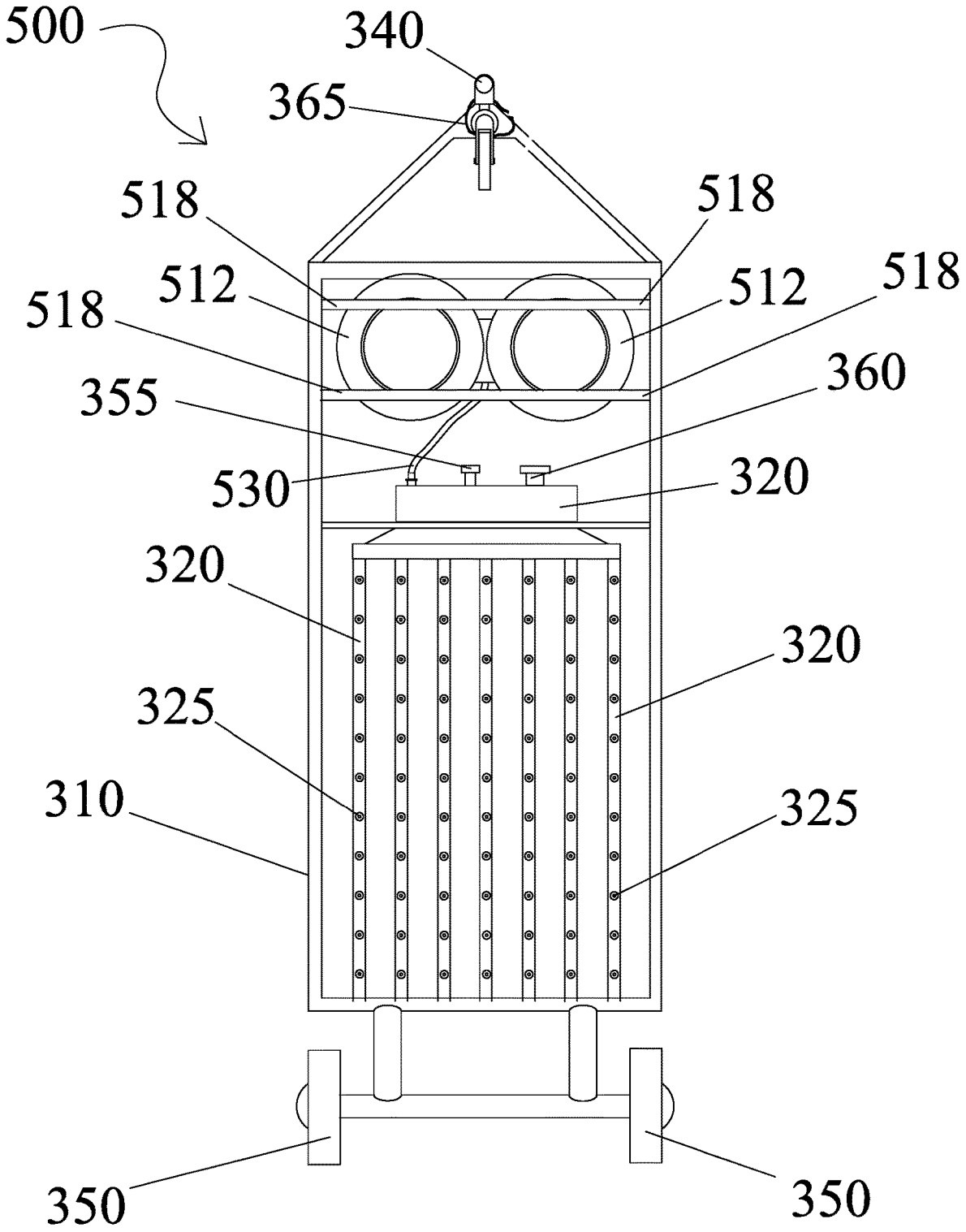
FIG. 14 is a bottom view of a snow and ice melting trailer device with dual propane tanks.
Figure 15:
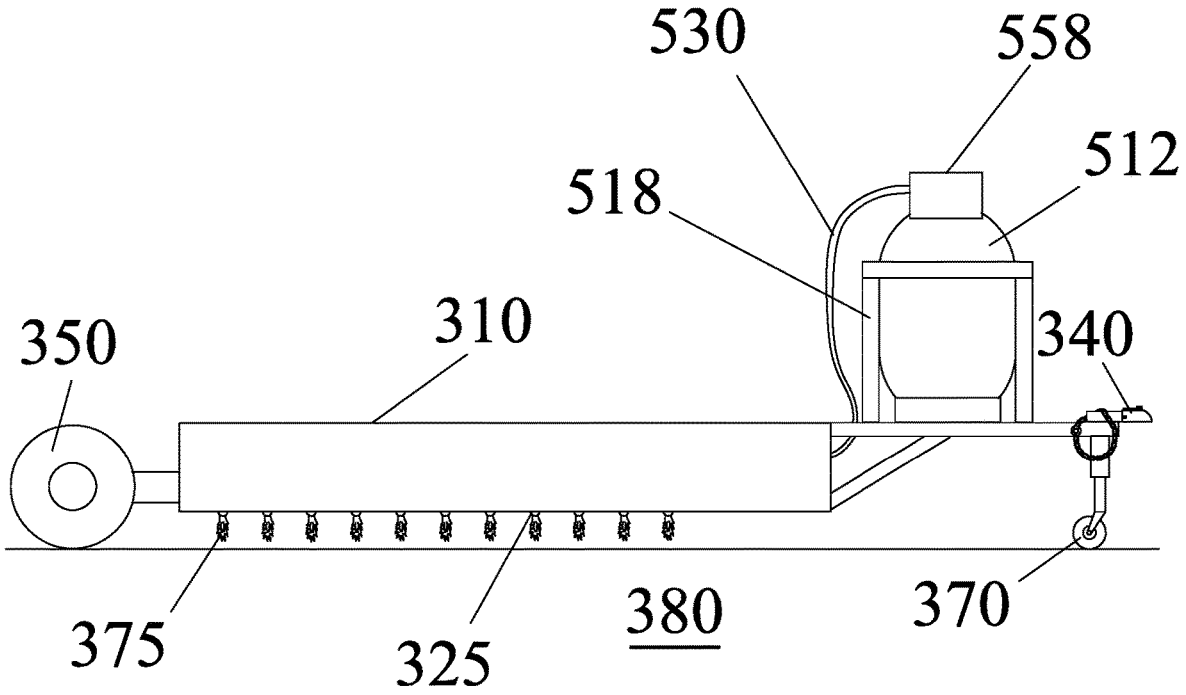
FIG. 15 is a side view of a snow and ice melting trailer device shown in FIG. 14.
Figure 21:
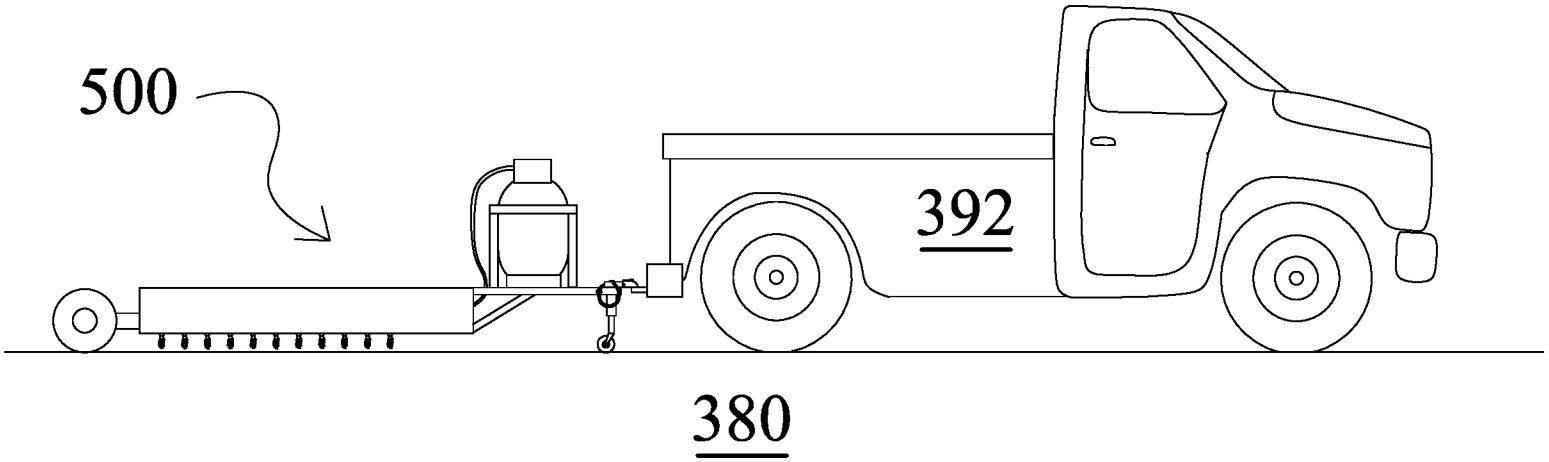
FIG. 21 is a side view of the snow and ice melting trailer device shown in FIG. 14 attached to a vehicle.

Referring to FIGS. 14, 15 and 21, a commercial snow and ice melting device 500 is shown with a frame 310 which includes propane tank supports 518 which hold propane tanks 512. Propane tank 512 is mounted on propane tank supports 518 and provides propane to burner jets 325 as described above. A regulator 538 connects using a propane line 530 to propane manifold 315 and is provided to regulate propane flow. In this embodiment, commercial snow and ice melting device 500 may be attached any vehicle 392.

Figure 16:
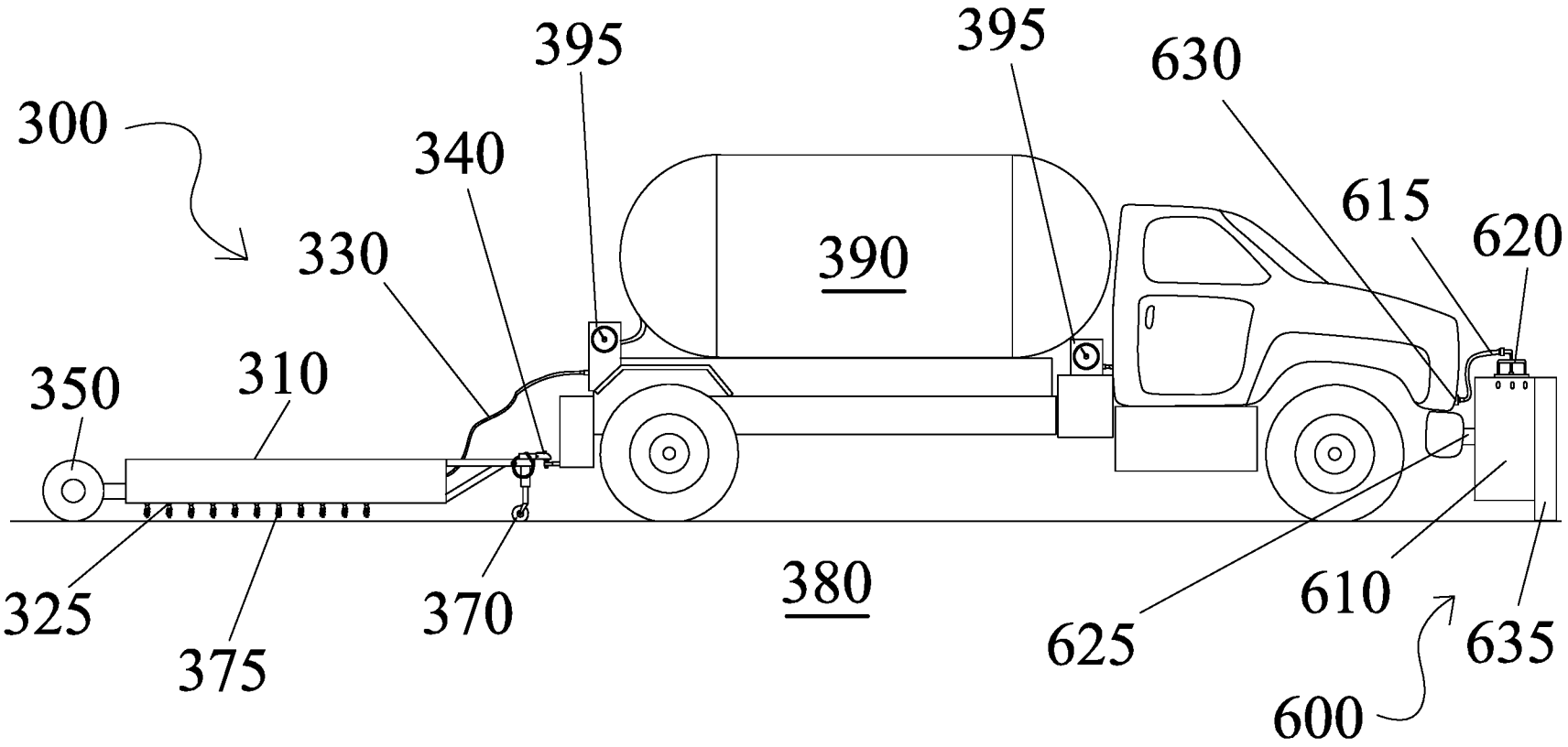
FIG. 16 is a side view of the snow and ice trailer melting device with a front snow and ice melting device attached.
Figure 17:
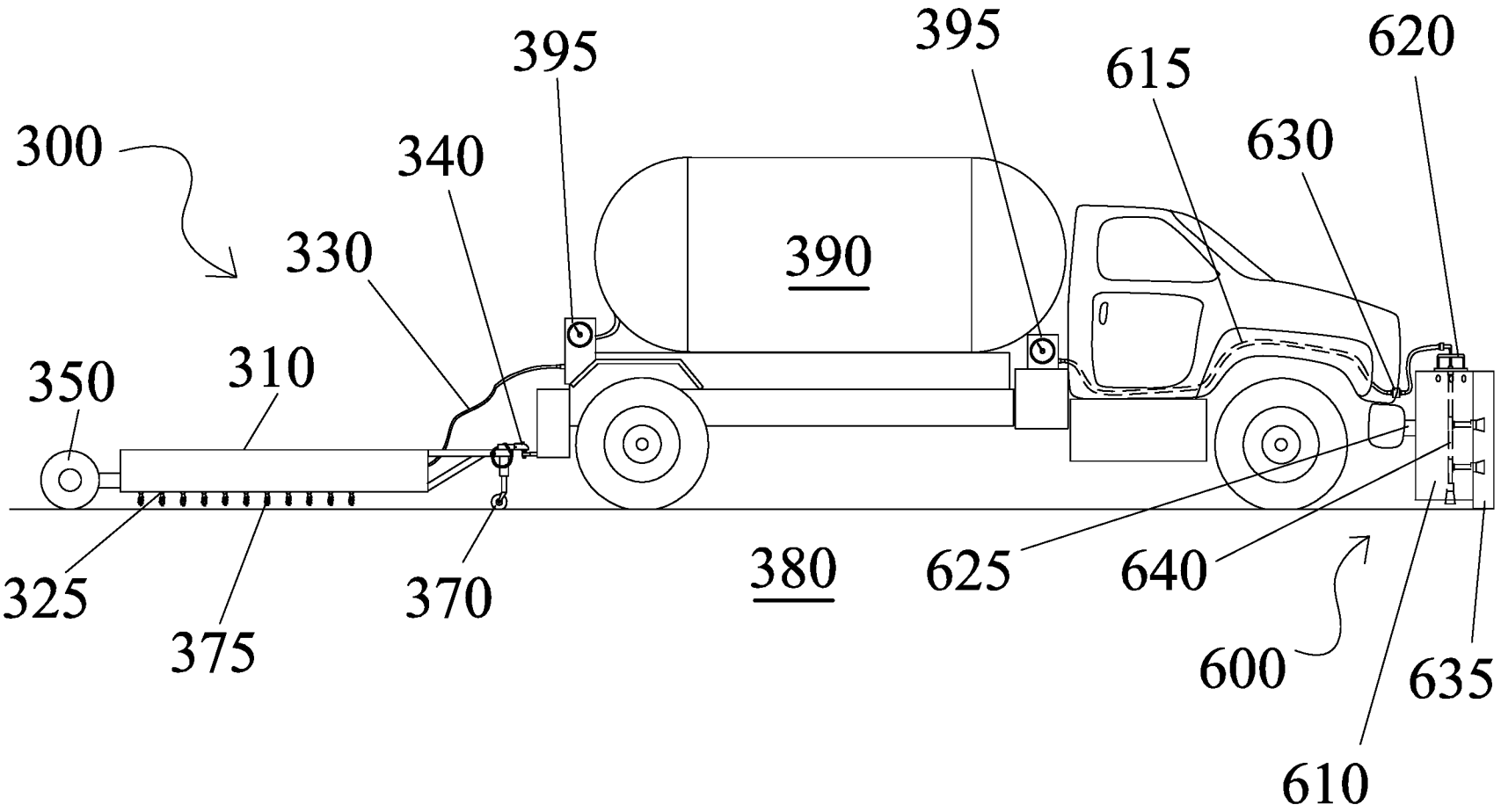
FIG. 17 is a semi-transparent side view of the snow and ice trailer melting device.

Referring now to FIGS. 16 and 17, a front mounted snow and ice melting device 500 is mounted to the front on propane truck 390 and includes a frame 610. Propane regulator 495 is provided to regulate the propane and supplies propane using a propane line 615 to connect to a flame nozzle assembly 640. A gas attachment fitting 630 is used to connect propane line 615 to propane truck. A heat plate 635 is provided to facilitate heat transfer from flame nozzle assembly 640 to heat plate 635. Heat plate 635 may make contact with snow and it also directs heat downward to melt ice beneath heat plate 635.

Access to flame nozzle assembly 640 is through a burner access panel 620. Access panel 620 is provided to allow the user access flame nozzle assembly 640. Heat plate 635 is rounded to evenly distribute the heat produced during operation. Heat plate 635 is made of steel but can be made of any suitable material such as, but not limited to aluminum or sheet metal, etc. Of course other geometries may be used for the heat plate, such as, but not limited to triangular, rectangular, etc. An attachment arm 625 may be used to connect front mounted snow and ice melting device 600 to propane truck 390. Of course other methods of mounting may be used including removable mounts as is known in the art.

Figure 18:
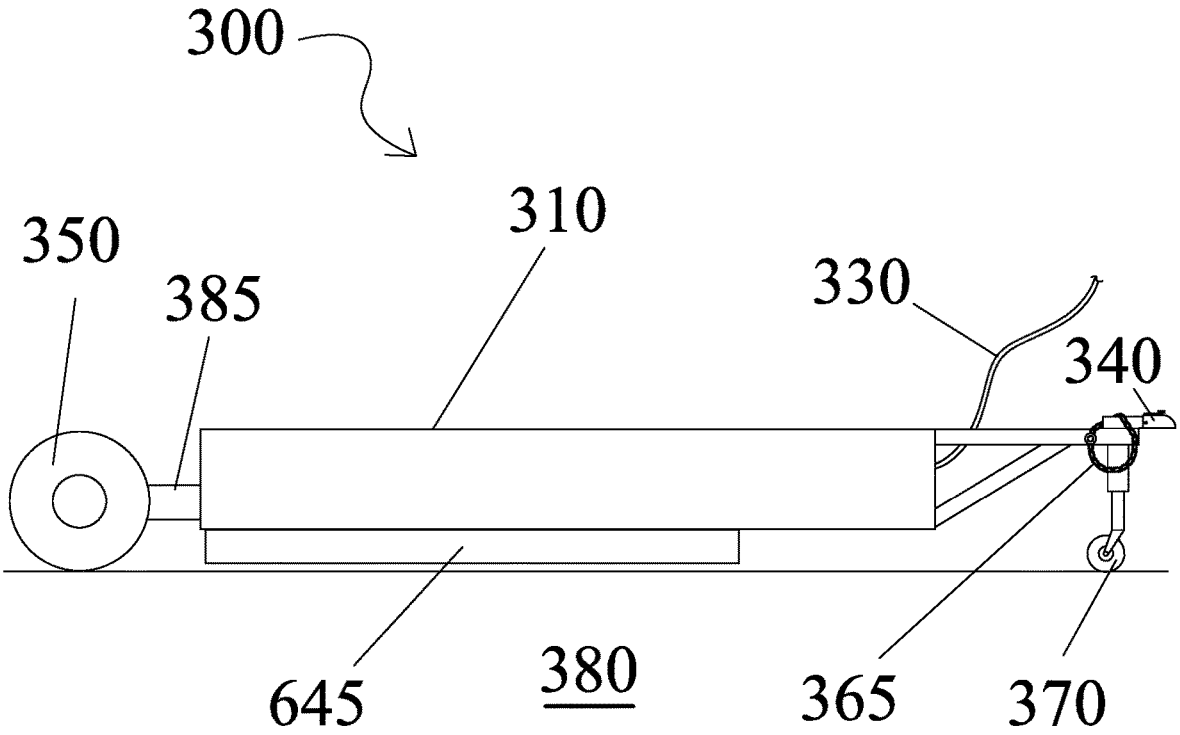
FIG. 18 is a side view of the snow and ice melting trailer device with an attached boot.
Figure 19:
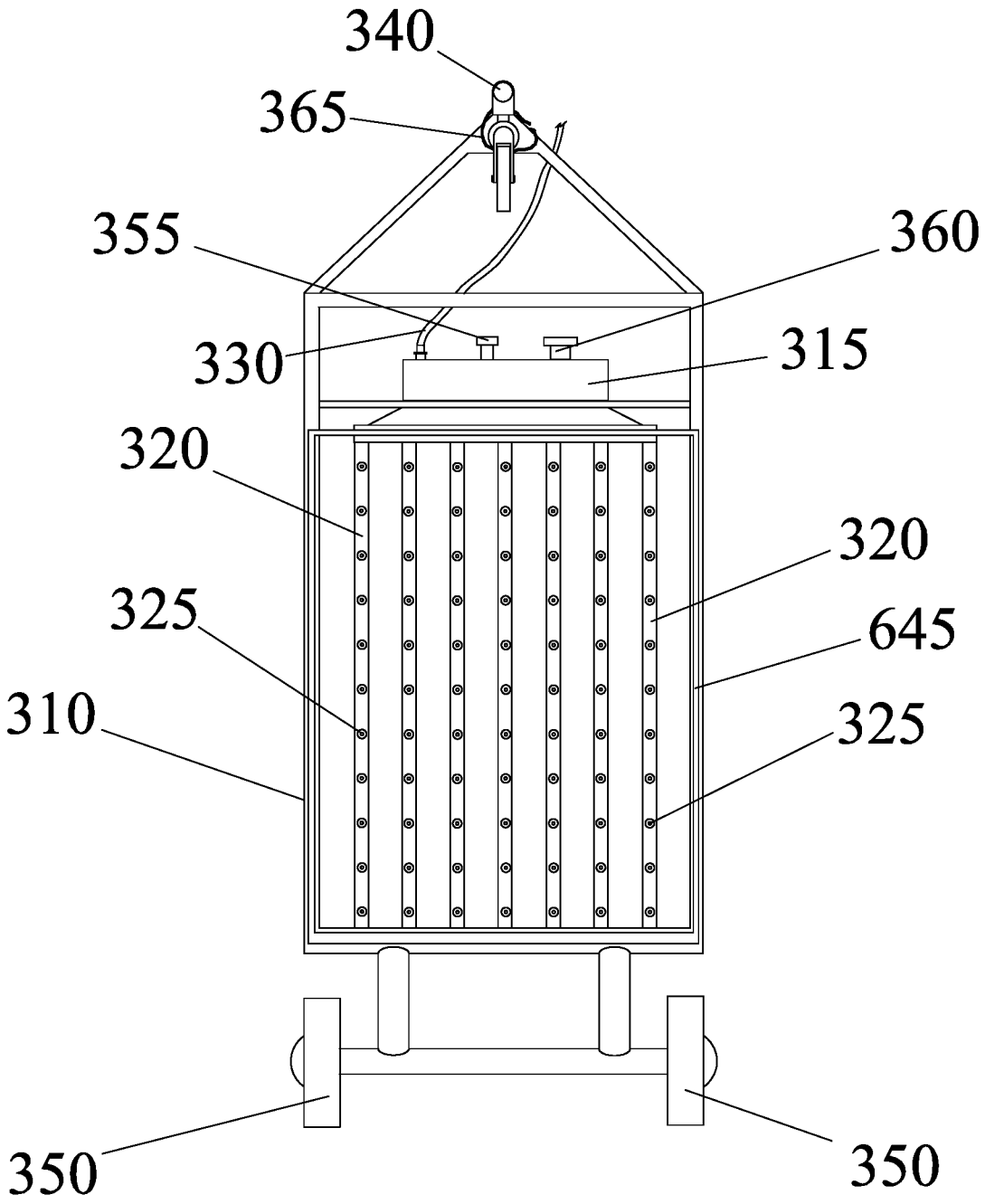
FIG. 19 is a bottom view of the snow and ice melting trailer device shown in FIG. 18.
Figure 20:
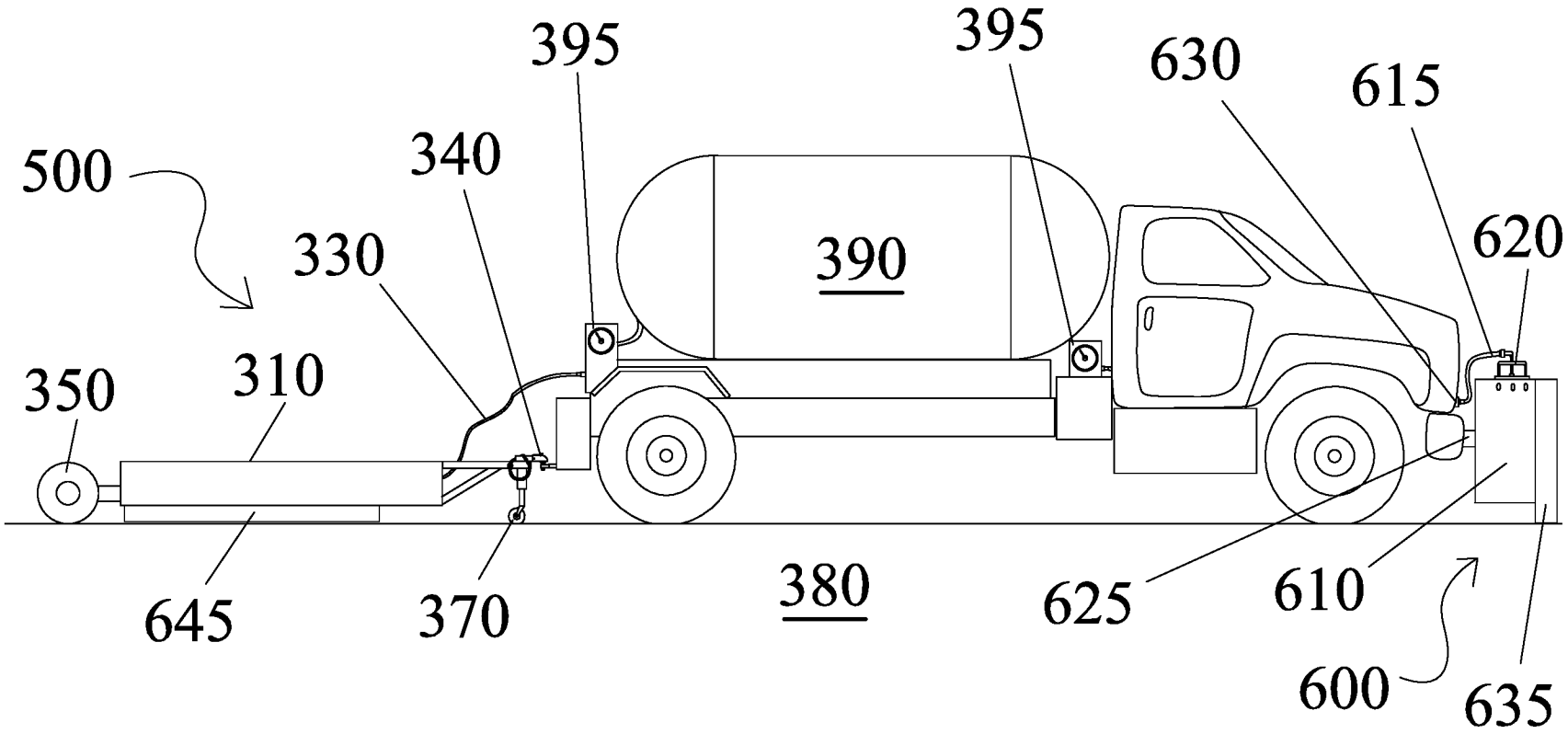
FIG. 20 is a side view of the snow and ice melting trailer device shown in FIG. 18 attached to a propane truck with a front snow and ice melting device attached.

Referring to FIGS. 18-20, commercial snow and ice melting device 300 is shown having a boot 645. Boot 645 surrounds burner jets 325 to further concentrate the heat produced to increase the melting of the snow and ice. Boot 645 is made of a flame resistant rubber and is flexible to provide movement if the surface to be cleared is uneven. Of course other materials may be used for boot 645 such as, but not limited to chain link, metal strips, etc. as long as the heat created is further contained and concentrated under the device.

Although the instant invention has been described in relation to particular embodiments thereof, many other variations and modifications and other uses will become apparent to those skilled in the art.

What is claimed is:

1. A snow and ice melting device comprising:

a frame;

said frame having a bottom portion and at least two vertically disposed wall portions generally parallel to opposed edges of said bottom portion;

said frame having a top portion extending between at least a portion of said at least two vertically disposed wall portions;

a heat plate mounted to a forward portion of said frame;

a flame nozzle assembly removably secured to said top portion;

at least one flame nozzle disposed on said flame nozzle assembly and directed towards said heat plate whereby said heat plate is heated to a temperature sufficient to melt snow and ice;

said heat plate forming a contiguous surface enclosing said at least one flame nozzle whereby precipitate is prevented from entering a space enclosed by said heat plate and said frame;

wheels mounted to a bottom portion of said frame;

a handle secured to a rearward portion of said frame;

a fuel source whereby said at least one flame nozzle is supplied with a fuel for a flame; and a regulator for regulating said fuel from said fuel source to said flame nozzle.

2. The snow and ice melting device according to claim 1 further comprising at least one flame nozzle directed downward towards a surface where snow and or ice is to be removed.

3. The snow and ice melting device according to claim 1 wherein said fuel source is propane.

4. The snow and ice melting device according to claim 1 further comprising a flame nozzle handle disposed on said top portion whereby said at least one flame nozzle assembly is removable for servicing.

5. The snow and ice melting device according to claim 1 whereby said fuel source is a propane tank mounted on said frame.

6. The snow and ice melting device according to claim 1, further comprising a propane tank support portion disposed on said frame whereby said propane tank is secured during operation.

7. The snow and ice melting device according to claim 1 further comprising:

a self-propelled riding assembly;

said self-propelled riding assembly comprising;

a power assembly;

a steering mechanism; and a power train for directing torque produced by said power assembly to a drive mechanism.

8. The snow and ice melting device according to claim 7 further comprising a seat attached to said self-propelled riding assembly whereby a user can be seated while in operation.

9. The snow and ice melting device according to claim 1 whereby said heat plate is semicircular in shape.

10. A snow and ice melting device comprising:

a frame;

said frame having an attachment portion whereby said frame is attachable to a vehicle;

said frame having a bottom portion and at least two vertically disposed wall portions generally parallel to opposed edges of said bottom portion;

said frame having a top portion extending between at least a portion of said at least two vertically disposed wall portions;

a heat plate mounted to a forward portion of said frame;

at least one flame nozzle directed towards said heat plate whereby said heat plate is heated to a temperature sufficient to melt snow and ice;

a flame nozzle assembly removably secured to said top portion;

at least one flame nozzle disposed on said flame nozzle assembly and directed towards said heat plate whereby said heat plate is heated to a temperature sufficient to melt snow and ice;

said heat plate forming a contiguous surface enclosing said at least one flame nozzle whereby precipitate is prevented from entering a space enclosed by said heat plate and said frame;

a fuel source whereby said at least one flame nozzle is supplied with a fuel for a flame; and a regulator for regulating said fuel from said fuel source to said flame nozzle.

11. The snow and ice melting device according to claim 10 whereby said vehicle is a propane truck.

12. The snow and ice melting device according to claim 10 where said fuel source is propane.

13. The snow and ice melting device according to claim 10 where said fuel source is a propane tank disposed on said frame.

* * * * *